US008220395B1

(12) United States Patent
Gorman et al.

(10) Patent No.: US 8,220,395 B1
(45) Date of Patent: Jul. 17, 2012

(54) METHOD OF CONVERTING BOMBLET TO GUN-LAUNCHED GRENADE

(75) Inventors: Ryan Gorman, Mountain Lakes, NJ (US); Philip Magnotti, Westfield, NJ (US); James Grassi, Rockaway, NJ (US); Matthew Millar, Union, NJ (US); James Hamfeldt, Hopatcong, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 27 days.

(21) Appl. No.: 12/975,697

(22) Filed: Dec. 22, 2010

(51) Int. Cl.
*F42B 27/00* (2006.01)

(52) U.S. Cl. ..... 102/482; 102/483; 86/51; 86/56

(58) Field of Classification Search ..... 102/482, 102/483, 488; 86/51, 56, 25
See application file for complete search history.

(56) References Cited

U.S. PATENT DOCUMENTS

| | | | | |
|---|---|---|---|---|
| 4,969,397 | A * | 11/1990 | Gunther et al. | 102/233 |
| 4,974,516 | A * | 12/1990 | Eyal et al. | 102/476 |
| 5,789,695 | A * | 8/1998 | Scherer et al. | 86/49 |
| 6,244,184 | B1 * | 6/2001 | Tadmor | 102/266 |
| 7,490,555 | B2 * | 2/2009 | Veksler | 102/393 |
| 2007/0034073 | A1 * | 2/2007 | Banks | 89/1.815 |

* cited by examiner

*Primary Examiner* — J. Woodrow Eldred
(74) *Attorney, Agent, or Firm* — Michael C. Sachs

(57) ABSTRACT

A Dual Purpose Improved Conventional Munition (DPICM) bomblet may be converted into a gun-launched grenade. The bomblet may include a fuze, a shaped-charge liner, a casing, and explosive material disposed between the shaped-charge liner and the casing. An ogive may be attached to an open end of the bomblet. A generally cup-shaped pusher may be placed over the fuze and attached to the bomblet casing. A conventional cartridge case assembly may be fixed to a fuze end of the bomblet. When the gun-launched grenade impacts a target, the casing may shatter to form shrapnel and a shaped-charge jet may be formed.

15 Claims, 4 Drawing Sheets

METHOD OF CONVERTING BOMBLET TO GUN-LAUNCHED GRENADE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to gun-launched grenades.

Some large gun-launched projectiles, such as 155 mm projectiles, may carry many submunitions or bomblets that may be expelled in flight. Each bomblet may be independently stablized and armed. One type of bomblet may include a point detonating fuze that detonates the bomblet on impact. Detonation of the bomblet may send anti-personnel fragments radially and may send a shaped-charge jet downward. A large number of gun-launched projectiles that contain bomblets may no longer be used. Thus, there may be millions of surplus bomblets.

If the surplus bomblets are destroyed, the large original capital investment in the bomblets will be lost. And, the process of de-militarizing the bomblets is an another large cost. A need exists for a cost-effective method of converting surplus bomblets into useful products.

SUMMARY OF THE INVENTION

It is an object of the invention to provide a cost-effective method for converting surplus bomblets into useful products.

One aspect of the invention is a method of converting a bomblet into a gun-launched grenade. The bomblet may include a fuze, a shaped-charge liner, a casing, and explosive material disposed between the shaped-charge liner and the casing. The method may include attaching an ogive to an open end of the bomblet. A generally cup-shaped pusher may be placed over the fuze. The pusher may be attached to the casing. A cartridge case assembly may be attached to the fuze end of the bomblet.

The pusher may include a driving band. Attaching the pusher may include press fitting the pusher to the casing. Attaching the cartridge case assembly may include mechanically crimping the cartridge case assembly to the pusher.

Another aspect of the invention is an alternative method of converting a bomblet into a gun-launched grenade. The bomblet may include a fuze, a shaped-charge liner, a casing, and explosive material disposed between the shaped-charge liner and the casing. The method may include removing the fuze from the bomblet. A generally cup-shaped pusher may be placed over the fuze end of the bomblet. The pusher may be attached to the casing. A spit back fuze may be attached to an open end of the bomblet. A cartridge case assembly may be attached to the fuze end of the bomblet.

The pusher may include a driving band. Attaching the pusher may include press fitting the pusher to the casing. Attaching the cartridge case assembly may include mechanically crimping the cartridge case assembly to the pusher. The spit back fuze may include a housing with a generally hemispherical nose.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A known Dual Purpose Improved Conventional Munition (DPICM) bomblet may be converted into a gun-launched grenade. The gun-launched grenade may be fired from, for example, 40 mm gun tubes. The process of converting the known DPICM bomblet into a gun-launched grenade may be about 30 to 60% cheaper than purchasing a new gun-launched grenade.

Figure 1A:
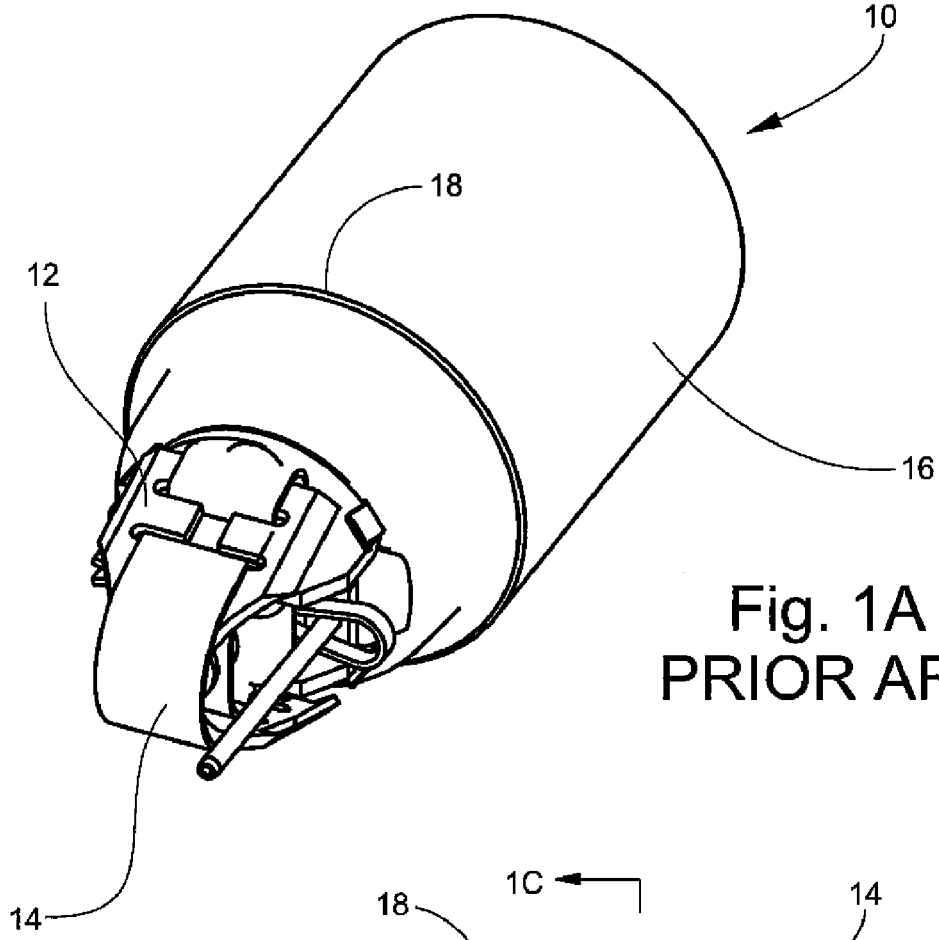
Fig. 1A PRIOR ART
FIG. 1A is a perspective view of a bomblet.
Figure 1B:
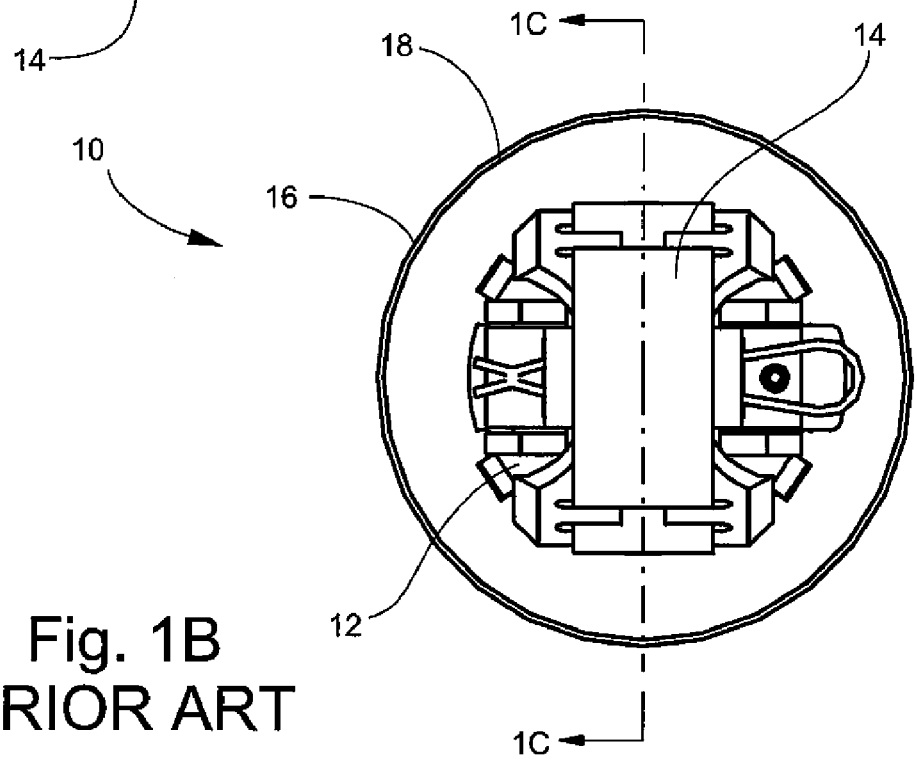
Fig. 1B PRIOR ART
FIG. 1B is a top view of the bomblet of FIG. 1A.
Figure 1C:
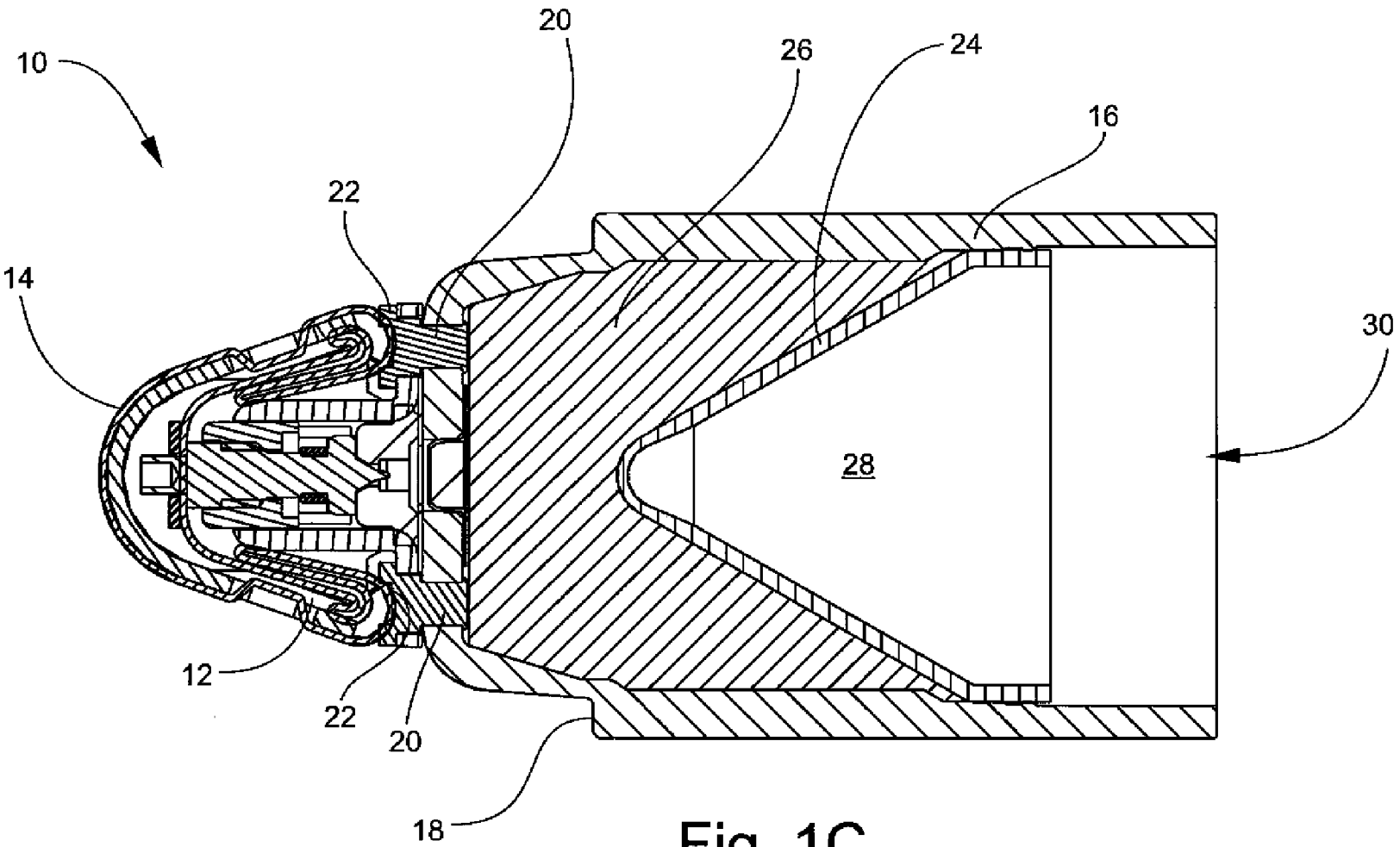
Fig. 1C PRIOR ART
FIG. 1C is a sectional view taken along the line 1C-1C of FIG. 1B.
Figure 2:
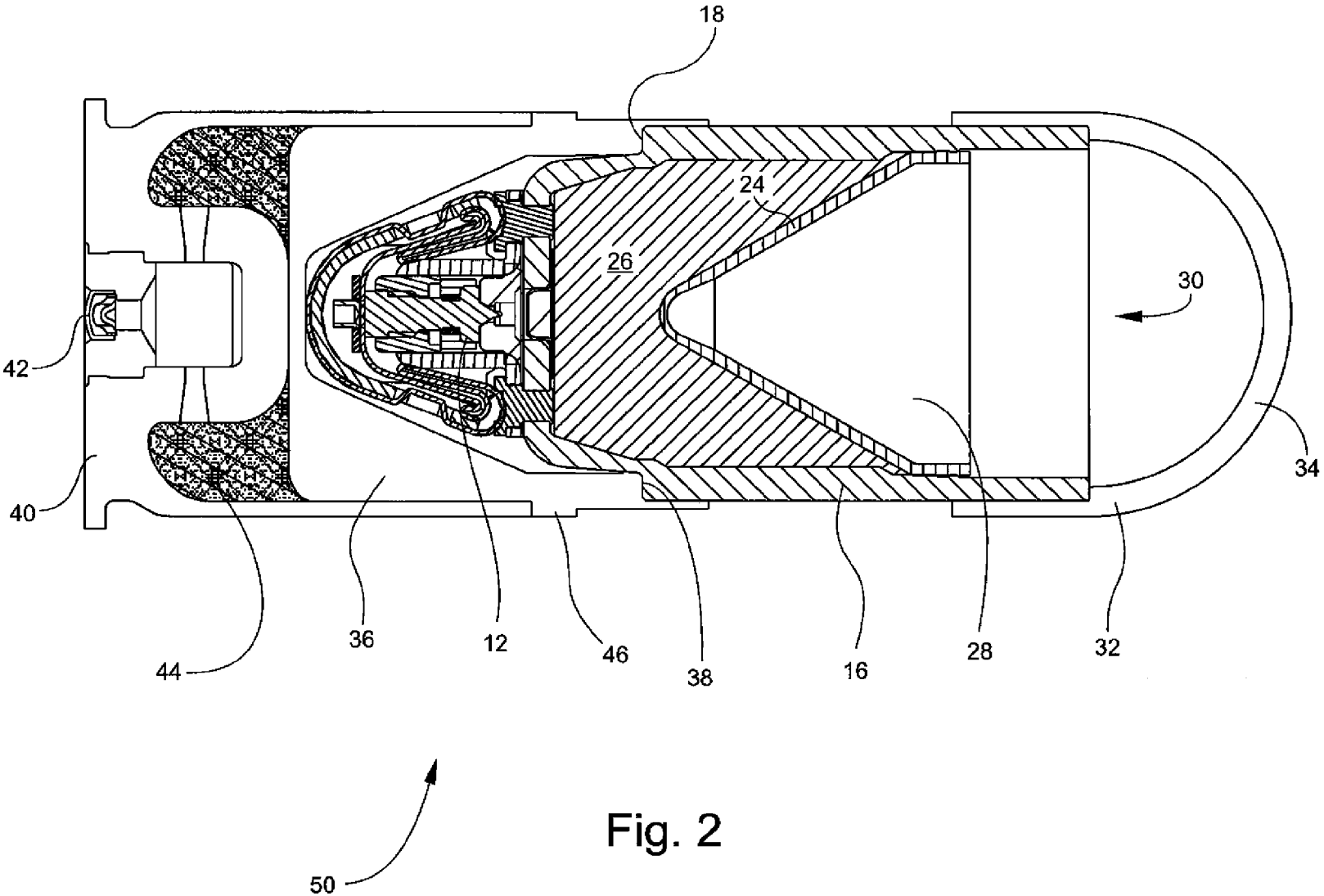
FIG. 2 is a cutaway side view of one embodiment of a gun-launched grenade formed from the bomblet of FIG. 1.

FIGS. 1A-C show an embodiment of a known DPICM bomblet 10. Bomblet 10 may include a fuze 12 staked thereon. Fuze 12 may be, for example, an M223 fuze. Studs 20 may be used to stake fuze 12 to bomblet 10. Fuze 12 may include a ribbon stabilizer 14. Bomblet 10 may include a steel casing 16 having an external shoulder 18. Explosive material 26 may be disposed between casing 16 and a shaped-charge liner 24. The exterior surface of liner 24 may define a cavity 28 with an open end 30.

Figure 3:
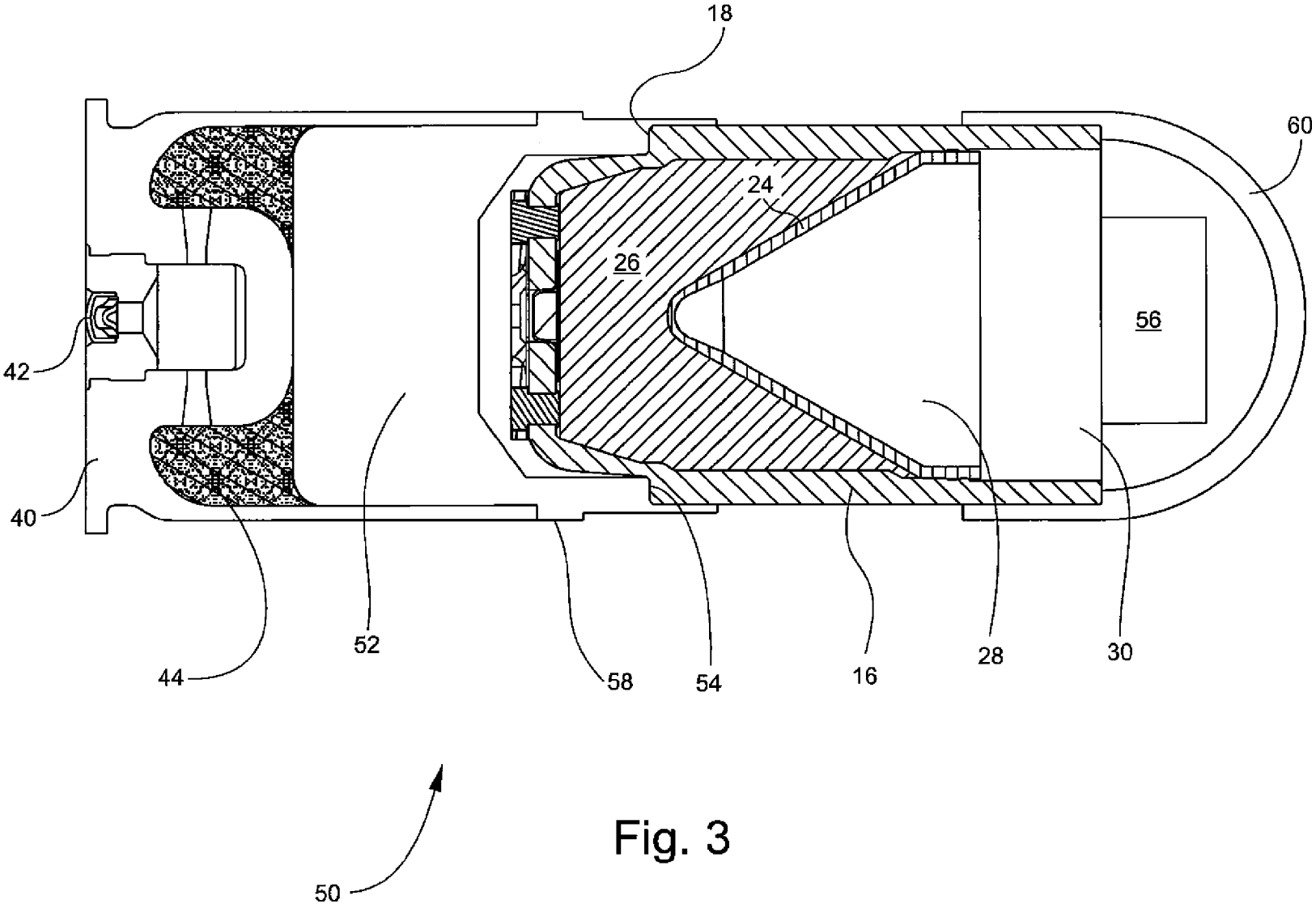
FIG. 3 is a cutaway side view of another embodiment of a gun-launched grenade formed from the bomblet of FIG. 1.

A method of converting bomblet 10 into a gun-launched grenade 50 (FIG. 3) may include fixing an ogive 32 over open end 30 of bomblet 10. Ogive 32 may have a generally hemispherical nose 34. Ogive 32 may be made of, for example, a polymer. Ogive 32 may be fixed to casing 16 using, for example, glue. A pusher 36 may be placed over fuze 12. Pusher 36 may be generally cup-shaped. Pusher 36 may include a ledge 38 that abuts shoulder 18 of casing 16. Pusher 36 may be made of, for example, a polymer or ceramic material. Pusher 36 may be press fit to casing 16. Adhesive may be used to fix pusher 36 to casing 16.

A driving band 46 may be used to impart spin to gun-launched grenade 50. Driving band 46 may be formed integral with or separate from pusher 36. In some embodiments, driving band 46 may be made of copper. A conventional cartridge case assembly 40, such as an M118 cartridge case, may be mechanically crimped to pusher 36. Cartridge case assembly 40 may include a primer 42 and propellant 44.

Grenade 50 may be launched from a weapon with a 40 mm caliber gun tube. Propellant 44 may propel pusher 36 and casing 16 out of the gun tube. Upon exit from the gun tube, pusher 36 may separate from casing 16. Arming of fuze 12 may occur via air flow interaction with ribbon stabilizer 14 and the spinning of grenade 50. Upon impact, fuze 12 may detonate explosive material 26. Explosive material 26 may shatter casing 16 to form shrapnel. A shaped-charge jet may be formed by the action of explosive material 26 and shaped charge liner 24.

In another embodiment of the invention, bomblet 10 may be converted into a gun-launched grenade 70 (FIG. 4). To convert bomblet 10 into gun-launched grenade 70, fuze 12 may be removed from bomblet 10. Fuze 12 may be removed by milling staked material 22 (FIG. 1C) and lifting fuze 12 from bomblet 10. A pusher 52 may be placed over the fuze end of bomblet 10. Pusher 52 may be generally cup-shaped. Pusher 52 may include a ledge 54 that abuts shoulder 18 of casing 16.

Pusher 52 may be made of, for example, a polymer or ceramic material. Pusher 52 may be press fit to casing 16. Adhesive may be used to fix pusher 52 to casing 16. A driving band 58 may be used to impart spin. Driving band 58 may be formed integral with or separate from pusher 52. In some embodiments, driving band 58 may be made of copper.

A conventional cartridge case assembly 40, such as an M118 cartridge case, may be mechanically crimped to pusher 52. Cartridge case assembly 40 may include a primer 42 and propellant 44. A conventional 40 mm spit back fuze 56 may include a housing 60 having a generally hemi-spherical nose. Fuze 56 may be placed over open end 30 of bomblet 10. Fuze 56 may be fixed to casing 16 using, for example, glue.

Gun-launched grenade 70 may function similar to gun-launched grenade 50. In grenade 70, spit back fuze 56 may detonate explosive material 26.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method of converting a bomblet into a gun-launched grenade, comprising:

providing the bomblet, the bomblet including a fuze, a shaped-charge liner, a casing, and explosive material disposed between the shaped-charge liner and the casing;

attaching an ogive to an open end of the bomblet;

placing a generally cup-shaped pusher over the fuze;

attaching the pusher to the casing; and attaching a cartridge case assembly to a fuze end of the bomblet.

2. The method of claim 1, wherein the pusher includes a driving band.

3. The method of claim 2, wherein attaching the pusher includes press fitting the pusher to the casing.

4. The method of claim 3, wherein attaching the cartridge case assembly includes mechanically crimping the cartridge case assembly to the pusher.

5. The method of claim 4, wherein the cartridge case assembly is an M118 cartridge case assembly.

6. The method of claim 5, wherein the fuze is an M223 fuze.

7. The method of claim 5, wherein the ogive comprises a polymer.

8. The method of claim 7, wherein the ogive has a generally hemispherical nose.

9. A method of converting a bomblet into a gun-launched grenade, comprising:

providing the bomblet, the bomblet including a fuze, a shaped-charge liner, a casing, and explosive material disposed between the shaped-charge liner and the casing;

removing the fuze from the bomblet;

placing a generally cup-shaped pusher over a fuze end of the bomblet;

attaching the pusher to the casing;

attaching a spit back fuze to an open end of the bomblet; and attaching a cartridge case assembly to the fuze end of the bomblet.

10. The method of claim 9, wherein the pusher includes a driving band.

11. The method of claim 10, wherein attaching the pusher includes press fitting the pusher to the casing.

12. The method of claim 11, wherein attaching the cartridge case assembly includes mechanically crimping the cartridge case assembly to the pusher.

13. The method of claim 12, wherein the cartridge case assembly is an M118 cartridge assembly.

14. The method of claim 13, wherein the fuze is an M223 fuze.

15. The method of claim 14, wherein the spit back fuze includes a housing with a generally hemispherical nose.

* * * * *